United States Patent [19]

Wenkman et al.

[11] Patent Number: 5,075,991

[45] Date of Patent: Dec. 31, 1991

[54] FRONT-LOADING DISPLAY FRAME

[75] Inventors: Gregory J. Wenkman, Middleton; Ferdinand F. Salzmann, Prairie du Sac, both of Wis.

[73] Assignee: Uniek Plastics, Inc., Waunakee, Wis.

[21] Appl. No.: 511,883

[22] Filed: Apr. 20, 1990

Related U.S. Application Data

[63] Continuation of Ser. No. 257,089, Oct. 13, 1988, abandoned.

[51] Int. Cl.[5] ..... A47G 1/06; G09F 1/12

[52] U.S. Cl. ..... 40/152.1; 40/152; 40/154; 40/600; 40/611; 40/597

[58] Field of Search ..... 40/152.1, 152, 154, 40/600, 597, 642, 611

[56] References Cited

U.S. PATENT DOCUMENTS

| | | | |
|---|---|---|---|
| 1,779,069 | 10/1930 | Lane . | |
| 2,450,495 | 10/1948 | Ullman . | |
| 3,230,653 | 1/1966 | Rice | 40/591 |
| 3,415,407 | 12/1968 | Alden et al. | 40/312 |
| 3,496,665 | 2/1970 | Goldman | 40/591 |
| 3,552,708 | 1/1971 | Hillstrom . | |
| 3,601,916 | 8/1971 | Epstein | 40/610 |
| 3,623,254 | 11/1971 | Parish, Sr. | 40/591 |
| 3,879,873 | 4/1975 | Sawyer . | |
| 4,016,664 | 4/1977 | Kaufmann | 40/642 |
| 4,432,152 | 2/1984 | Daenen | 40/152.1 |
| 4,691,456 | 9/1987 | Ackeret | 40/490 |

FOREIGN PATENT DOCUMENTS

| | | | |
|---|---|---|---|
| 3402517 | 1/1984 | Fed. Rep. of Germany | 44/611 |

*Primary Examiner*—Laurie K. Cranmer
*Assistant Examiner*—J. Hakomaki
*Attorney, Agent, or Firm*—Quarles & Brady

[57] ABSTRACT

A frame (10) has an integral outer margin (24) and a back plate (26). A display item (28) such as a picture, photograph, certificate, document, or the like is front-loaded into the frame (10) by insertion of the corners of the display item (28) into slots (50). The display item (28) is thus held against the back plate (26) and bounded by the outer margin (24). A flexible transparent sheet (30) fits over the top of the display item (28) and is inserted into the slots (50) in like manner. The frame (10) has a bracket (44) such that the frame (10) may be mounted upon a horizontal surface such as a table, desk, counter or the like. The bracket may be inserted into different sockets (36), (38), (40), and (42) to change the orientation of the display item (28). The frame (10) may also be mounted upon a vertical surface such as a wall by use of either of holes (35), (37), (39), (41), depending upon the desired orientation of the display item (28) a magnet (64) or suction cup (68) may also be used for mounting upon other types of vertical surfaces.

5 Claims, 11 Drawing Sheets

FRONT-LOADING DISPLAY FRAME

This application is a continuation of application Ser. No. 07/257,089, filed Oct. 13, 1988, now abandoned.

FIELD OF THE INVENTION

This invention relates to frames used to mount and display pictures, photographs, certificates, documents, or the like.

BACKGROUND OF THE INVENTION

Picture frames are commonly used to mount, display, and protect pictures or documents. Most picture frames are comprised of an outside margin that borders the photograph or document, a transparent pane or sheet that fits within the outside margin and which serves to protect the photograph or document, and one or more back plates. The photograph or document is mounted by the removal of the one or more back plates, the insertion of the picture or document behind the transparent pane or sheet, the placement of the back plate over the backside of the picture or document, and the securing of the back plate in place. The transparent pane or sheet, the photograph or document, and the one or more back plates typically will fit into a recess in the outside margin. This assembly of the transparent pane or sheet, the picture or document, and the back plate are typically secured by wedging the assembly against the recess in the outside margin with some sort of fastener. The picture frame may then be displayed on a wall by attaching a length of wire to the side of the back plate not facing the picture or document and stringing the wire over a nail or other protrusion in a wall. Other means of hanging and displaying picture frames are well-known such as the use of hooks and/or holes.

The assembly of such frames and the subsequent mounting can be time-consuming. This is especially true where it is desired to replace one photograph or other display item with another, requiring removal and reassembly. Most of the frames of the prior art are typically expensive both to purchase and manufacture. These frames also require appropriate packaging to ship and to prevent from breaking.

SUMMARY OF THE INVENTION

In accordance with the present invention, a rectangular picture frame has an integral outer margin and back plate. The front of the frame has four corners that are each slotted to receive a square picture or document corner. The four corners of the picture or document that is to be displayed are inserted into the four slotted corners, thus securing the picture or document in place and the outer margin thus forms an attractive border around the picture or document. The back plate which is an integral part of the outer margin gives rigidity and support to the picture or document. A transparent, flexible acetate cover sheet fits over the top of the photograph or document and also fits within the slotted corners to protect the photograph or document.

The picture or document in the frame may be displayed by hanging upon a wall, a refrigeration or other steel surface, or upon a mirror, window or other smooth, flat vertical surface; the picture frame also may be set upon a table, counter, or other horizontal surface by means of a stand. There are four holes in the back plate that may be used to hang the frame upon a nail or hook in the wall with different orientations. A magnet mounted upon the side of the back plate that opposes the side used for display of the picture or document may be used to display the frame upon a refrigerator or other steel surface. In order to stand the frame upon a table, desk, counter, or other horizontal surface, a bracket may be fitted into one of four sockets on the side of the back plate that opposes the side used for display of the picture or document, each of the sockets being positioned along a length of the rectangular shape of the frame. The frame may therefore be hung, stood, or otherwise displayed according to the orientation of the picture or document.

The frame is thin-walled and may be inexpensively molded in one piece out of plastic. The frame is designed with stacking legs to allow shipping in stacks. The use of stacking legs minimizes scratching when the frames are shipped and eliminates the need for packaging.

Further objects, features, and advantages of the invention will be apparent from the following detailed description taken in conjunction with the accompanying drawings.

DESCRIPTION OF THE PREFERRED EMBODIMENT

Figure 1:
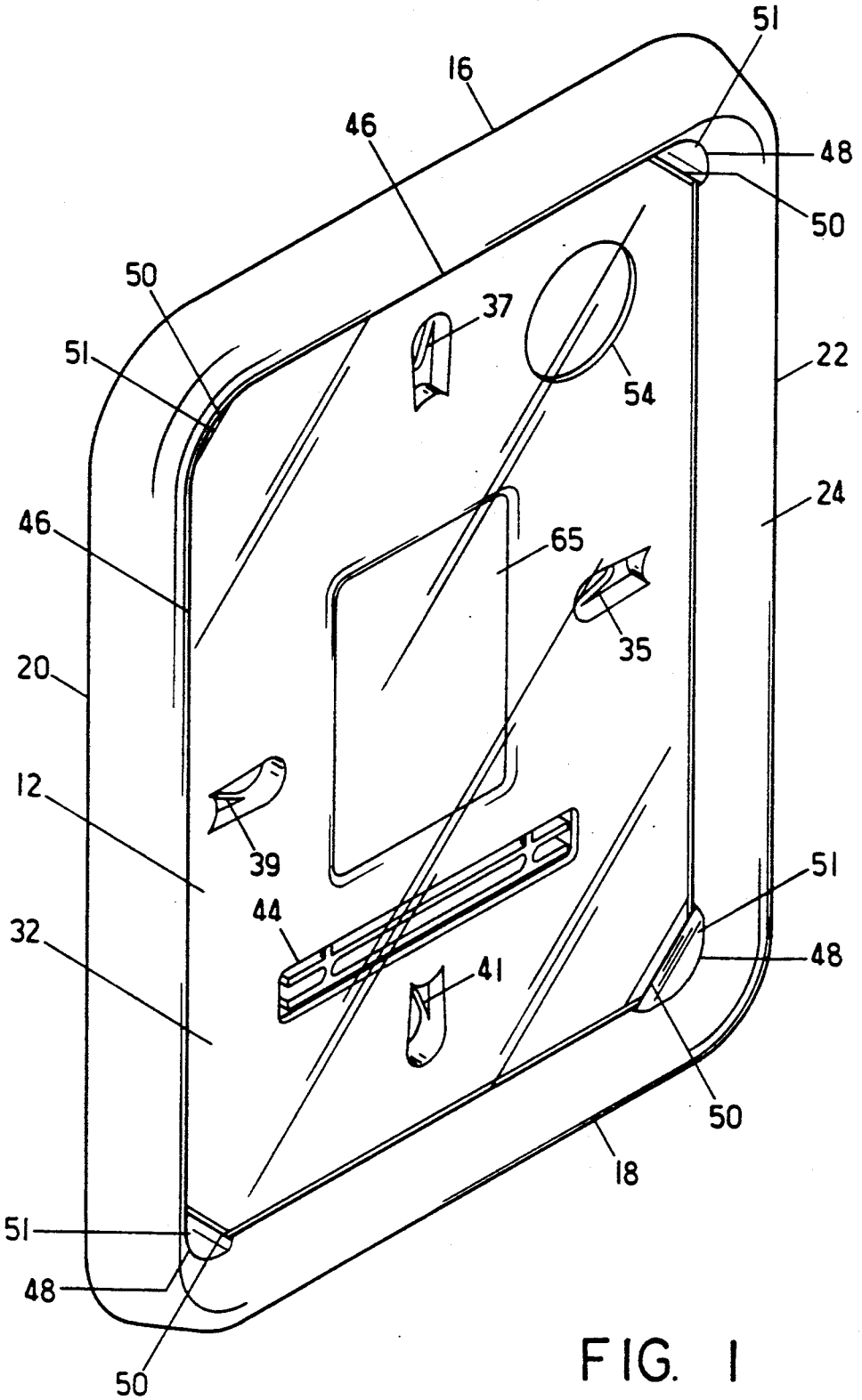
FIG. 1 is a perspective view of the frame of the present invention.
Figure 2:
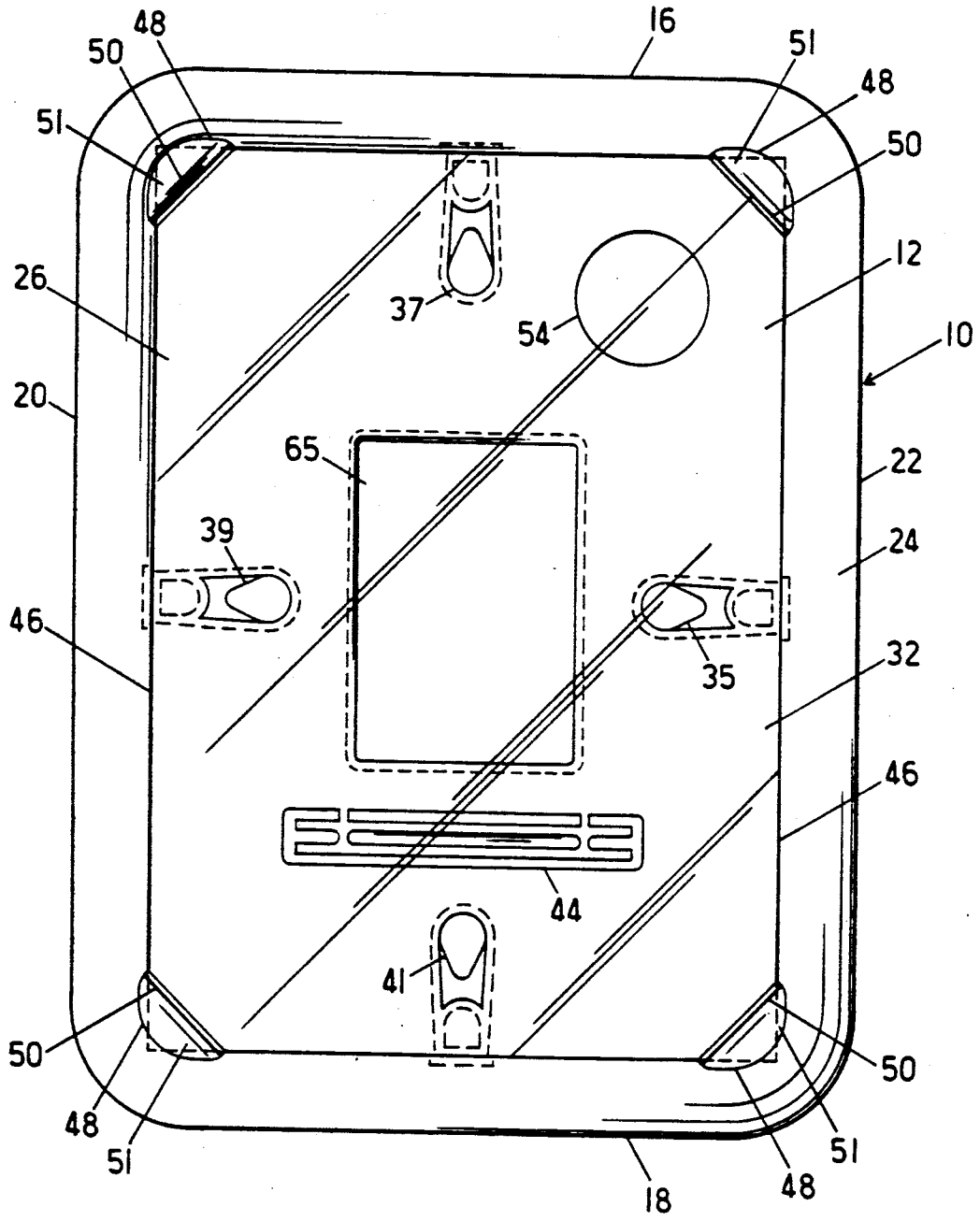
FIG. 2 is a front view of the frame of the present invention without the display item in place.

With reference to the drawings, a frame constructed in accordance with the present invention is shown at 10 in FIGS. 1–3. The frame 10 is preferably rectangular in shape and has a front 12, a back 14, a top 16, a bottom 18, and two opposing sides 20 and 22. The frame 10 has an outer margin 24 and a back plate 26 that are integrally formed, such as by a molding process. A display item 28 such as a picture, photograph, certificate, document, or the like is positioned within the outer margin 24 and against the back plate 26 so that the outer margin 24 forms a border for the display item 28 and the back plate provides rigid support for the display item 28. A transparent sheet 30 fits over the top of the display item 28 to protect it and hold it in place against the back plate 26. The back plate 26 has a front 32 and a back 34 analogous to the front 12 and the back 14 of the frame 10 itself. The back plate 26 has four tear-shaped holes 35, 37, 39, and 41, each of which is centrally located along the length of the rectangular shape of the frame 10 that are used to hang the frame 10 upon a nail, hook, or the like. The back plate 26 also has four sockets 36, 38, 40, and 42, each of which is also centrally located along the length of the rectangular shape of the frame 10. A bracket 44 may be insertable into any one of the four sockets 36, 38, 40, and 42 to act as a stand as the display frame may be positioned upright on a horizontal surface such as a desk, table, or counter. The bracket 44 may be inserted into any one of the four sockets 36, 38, 40, and 42, depending upon the desired orientation of the display frame 10.

Figure 8:
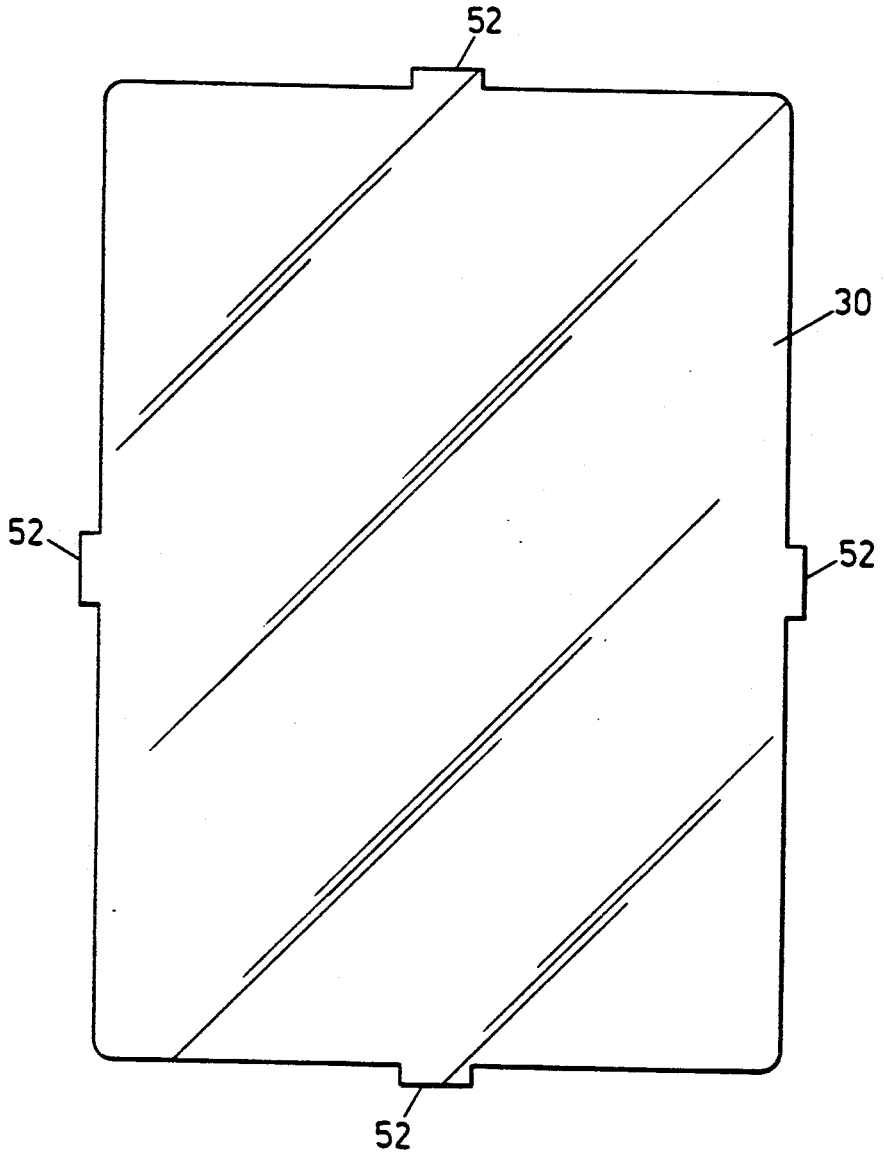
FIG. 8 is a front view of the protective sheet.

In the front 12 of the frame 10, the back plate 26 is recessed from the outer margin 24 and the outer margin 24 has an inside surface 46 that contacts the back plate 26. The inner surface 46 is shaped to form corners 48; at each of the corners 48, the inner surface 46 of the outer margin 24 has slots 50. The display item 28 is preferably rectangular, the length and width of the display item 28 being equal to or slightly less than the length and width of the front 32 of the back plate 26. To insert the display item 28 into the frame 10, the display item 28 is flexed to insert the corners of the display item 28 into the slots 50 at each of the corners 48. A ledge 51 is angled downward in each of the corners 48 and holds the display item 28 and the transparent sheet 30 in place. The display item 28 is thereby retained within the outer margin 24 and against the back plate 26 by the slots 50, the ledges 51, and by the bounds of the inside surface 46. The transparent sheet 30 is flexible and shaped rectangularly, the length and width of the transparent sheet 30 being equal to or slightly less than the length and width of the front 32 of the back plate 26. The transparent sheet 30 is inserted in the same manner as the display item 28, the transparent sheet fitting over the top of the display item 28 to serve as a means of protection. A suitable material for the transparent sheet 30 is acetate. As shown in FIG. 8, the transparent sheet 30 may also incorporate ears 52 on its edge. The ears 52 are insertable into corresponding notches 53 which are indented in the inside surface 46 of the outer margin 24.

The back plate 26 has a hole 54 which communicates between the front 32 and the back 34 of the back plate 26. The hole 54 is large enough to accommodate a human finger. The finger may be inserted from the back 34 of the back plate 36 when it is desired to change the display item 28. The finger thus pushes against the display item 28 and withdraws the display item 28 from the slots 50 at least partially to assist the user in removal of the display item 28. The frame 10 of the present invention allows for ease of framing of the display item 28 by means of its front-loading of the display item 28, but also facilitates removal and replacement of the display item 28.

Figure 3A:
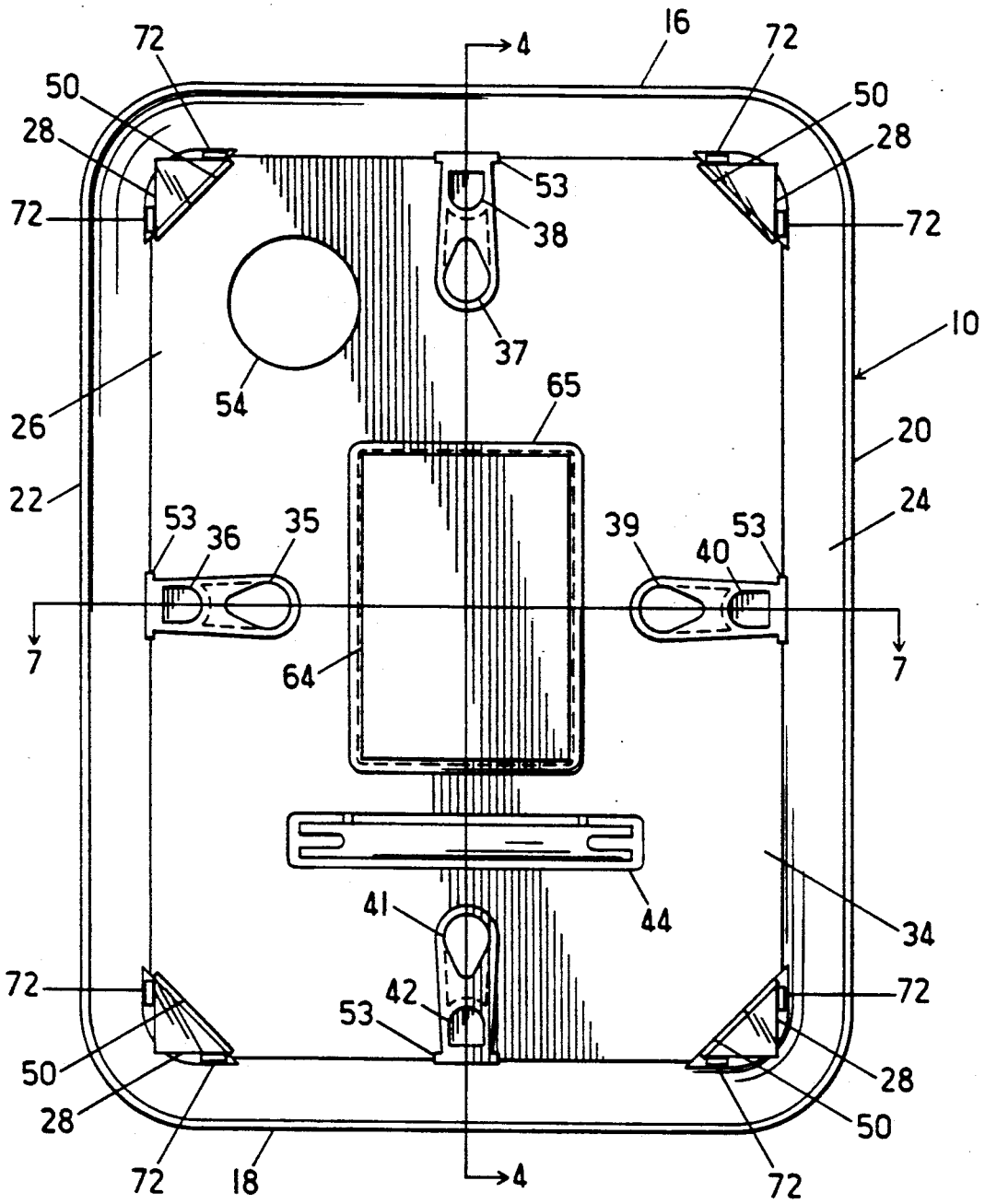
FIG. 3A is a back view of an embodiment of the frame having a magnet and with the display item in place.
Figure 3B:
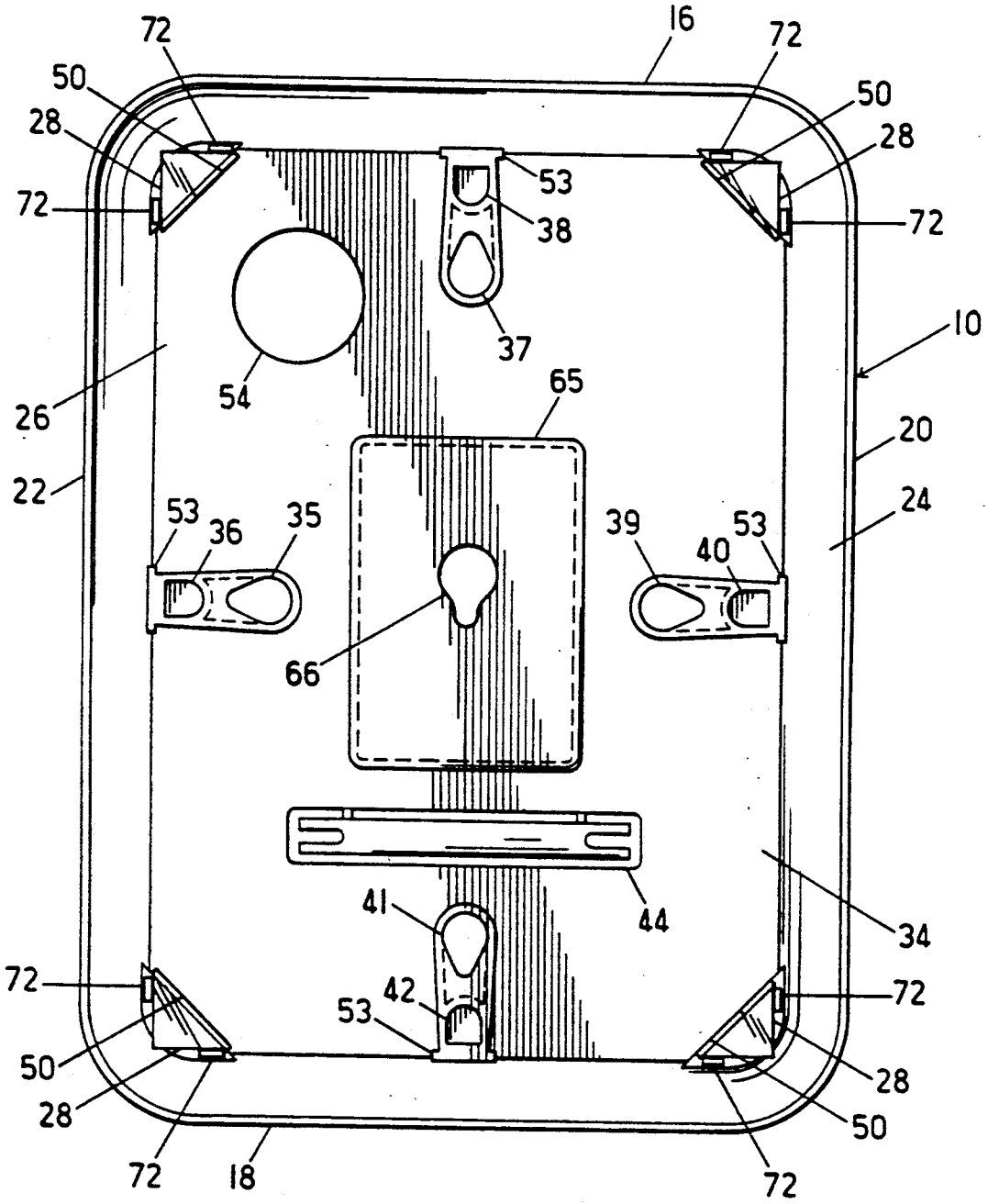
FIG. 3B is a back view of an embodiment of the frame having a keyhole adaptable to receive a suction cup and with the display item in place.
Figure 9:
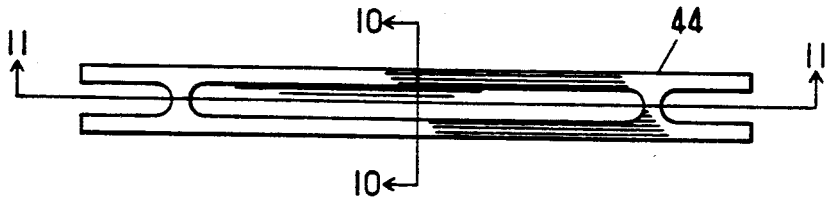
FIG. 9 is a bottom view of the bracket.
Figure 10:
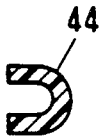
FIG. 10 is a cross-section taken along line 10—10 of FIG. 9.
Figure 11:
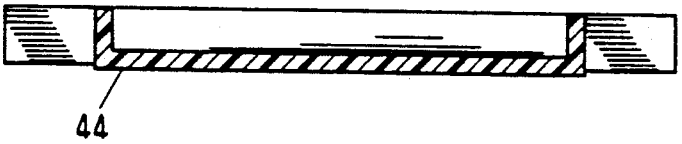
FIG. 11 is a cross-section taken along line 11—11 of FIG. 9.
Figure 13:
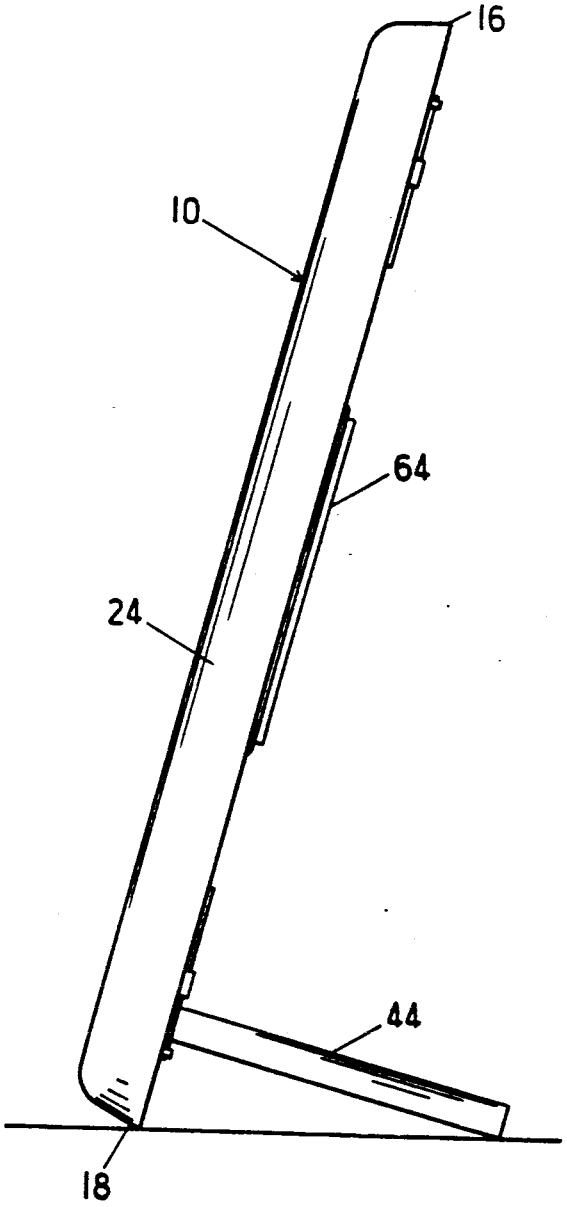
FIG. 13 is a side view as shown in FIG. 5, except that the bracket is inserted to form a stand.

As shown in FIGS. 3A and 3B, the bracket 44 is integrally molded with the frame 10 and may be easily pried from the back 34 of the back plate 26. FIGS. 9, 10, and 11 show the bracket as it looks when liberated from the back 34 of the back plate 26. If desired to be stood upon a horizontal surface such as a table, desk, counter, or the like, the bracket 44 may then be inserted into one of the sockets 36, 38, 40, and 42. The sockets 36, 38, 40, and 42 are preferably D-shaped and receive the bracket 44, which is also D-shaped, in a press fit arrangement. The fit between the bracket 44 and either of the sockets 36, 38, 40, and 42 may optionally be a snap fit if designed such that the bracket 44 has a protrusion and the sockets 36, 38, 40, and 42 have a mating undercut. The bracket 44 may therefore be used as a stand in the mounting of the frame 10. FIG. 13 shows a side view of the frame 10 with the bracket 44 inserted into one of the sockets. The sockets 36, 38, 40, and 42 are each located along a length of the rectangular shape, thus enabling the frame 10 to be mounted with a horizontal orientation (as in sockets 36 and 40) or a vertical orientation (as in sockets 38 and 42). As shown in FIG. 3A, the display frame 10 also has a magnet 64 that may be used to affix the frame 10 to a refrigerator or other vertically oriented ferrous surface to which the magnet 64 would adhere. The magnet 64 is attached to a ledge 65 upon the back 34 of the back plate 26 so that the magnet 64 is positioned at a height so that the outer margin 24 is flush with the ferrous surface to which the magnet 64 is adhered.

Figure 12:
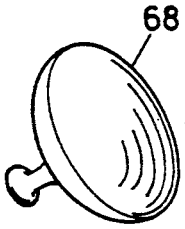
FIG. 12 is a perspective view of a suction cup that may be insertable into the keyhole as shown in FIG. 3B.

FIG. 3B shows an alternate embodiment in which a keyhole 66 is substituted for the magnet 64. In this embodiment, the keyhole 66 receives a suction cup 68 which may be used to then attach the frame 10 to a window, mirror, or other smooth surface. An example of a suction cup is shown in FIG. 12.

Figure 3C:
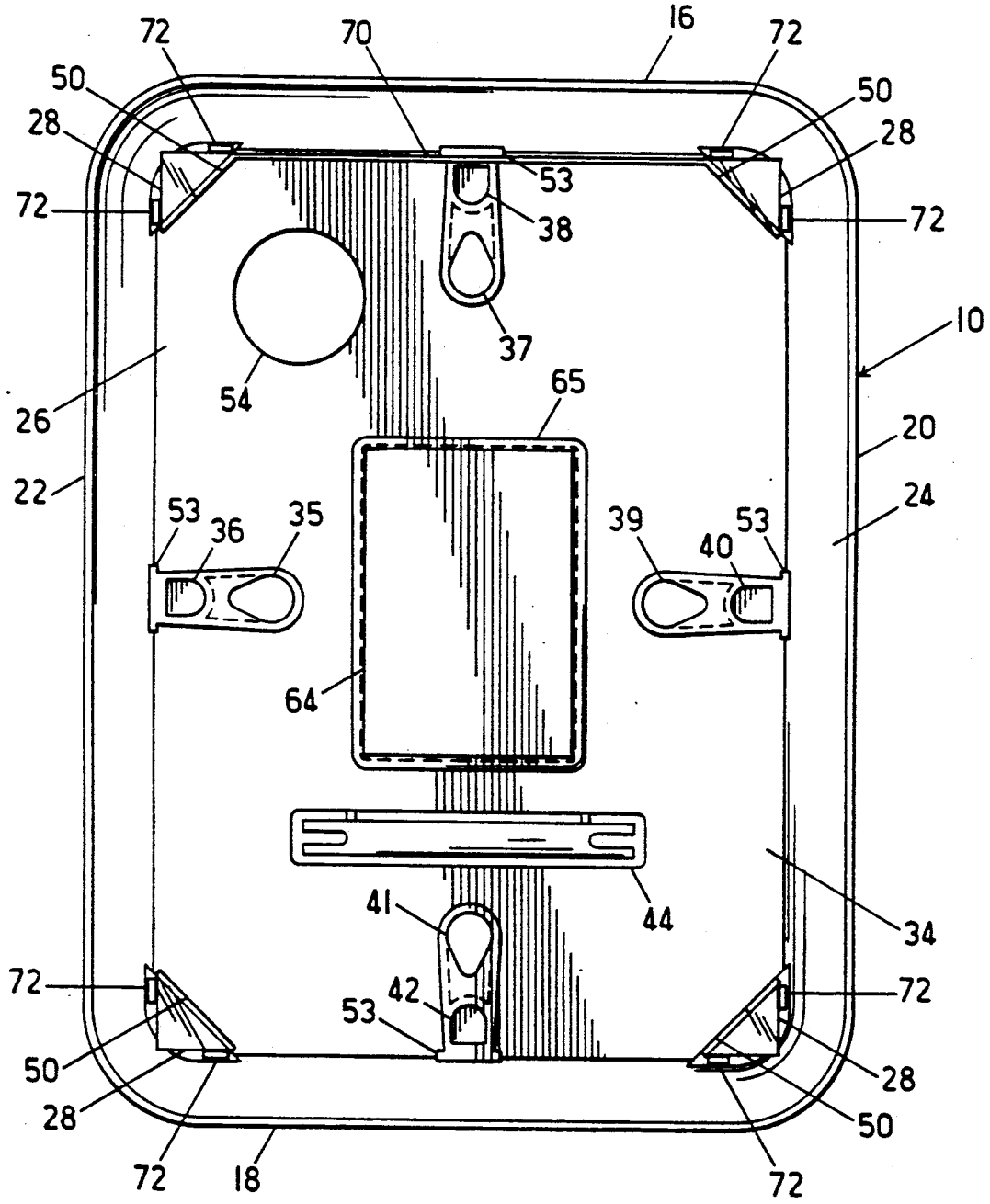
FIG. 3C is a back view of an embodiment of the frame having a magnet and with the display item in place and having a slit between two of the slots to accept an oversized display item.
Figure 3D:
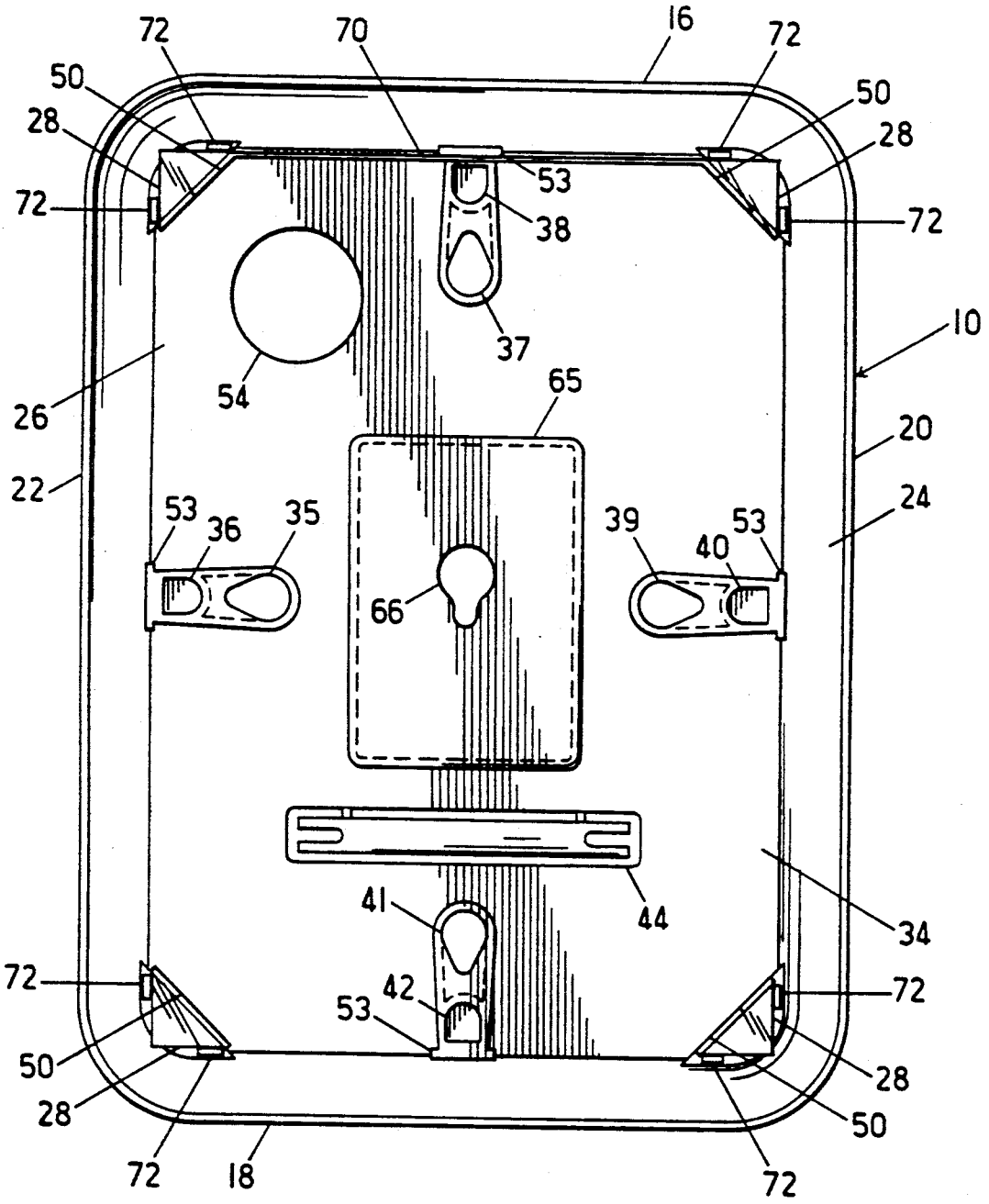
FIG. 3D is a back view of the frame having a keyhole adaptable to receive a suction cup and with the display item in place having a slit between two of the slots to accept an oversized display item.
Figure 4:
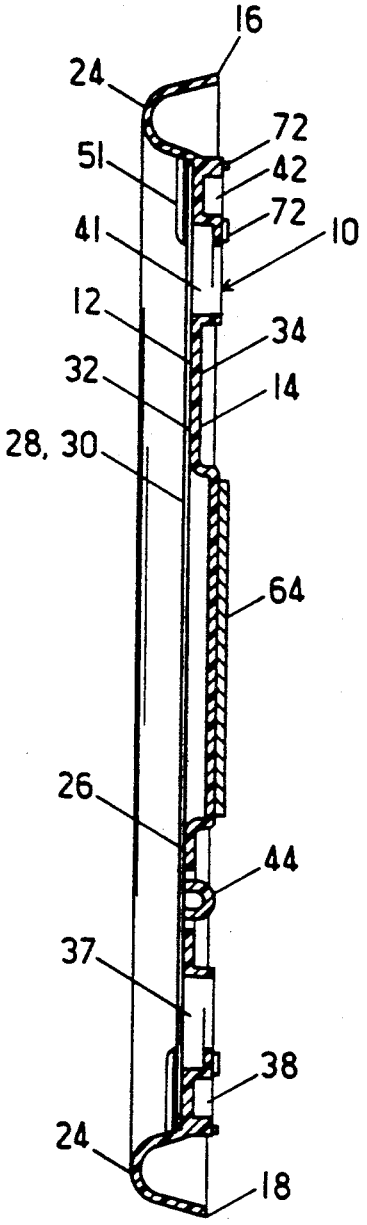
FIG. 4 is a cross-section taken along line 4—4 of FIG. 3, showing the bracket section as it is molded to the back plate and showing two of the holes by which the frame may be hung.
Figure 5:
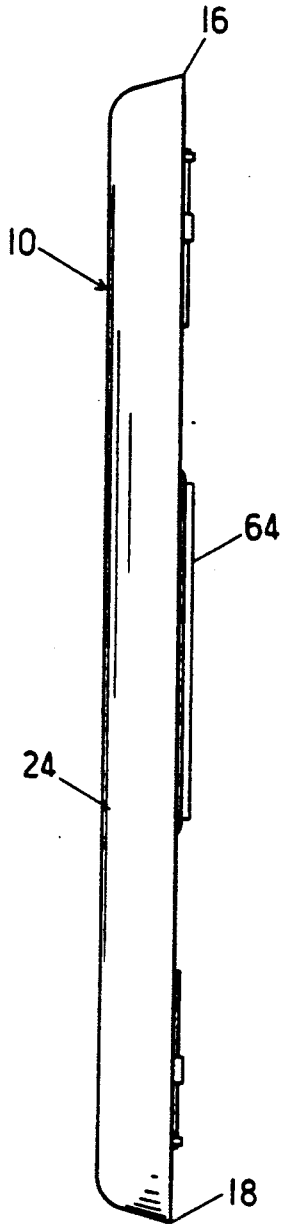
FIG. 5 is a side view of the frame.
Figure 6:
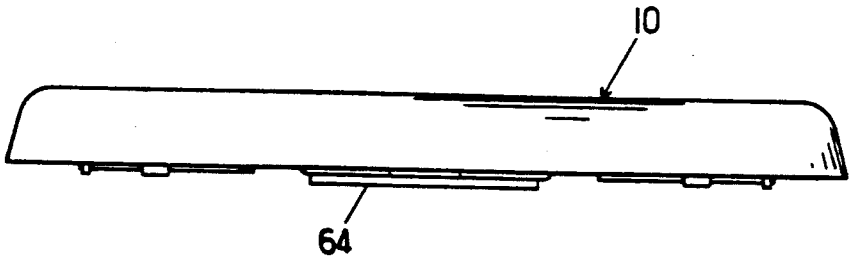
FIG. 6 is a top or a bottom view of the frame.
Figure 7:
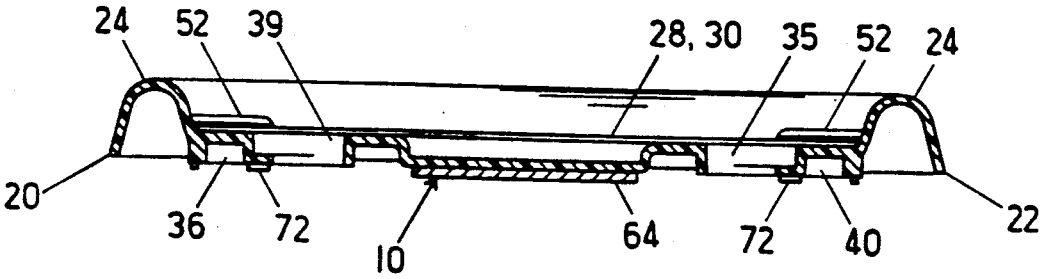
FIG. 7 is a cross-section taken along line 7—7 of FIG. 3, showing two of the holes by which the frame may be hung.

FIGS. 3C and 3D show alternate embodiments of FIGS. 3A and 3B. In these embodiments, the back plate 26 has a slit 70 across two of the slots 50. This allows a display item 28 to be mounted within the frame 10 such that the display item 28 may be oversized and hang over the slit 70 without a need to trim the length of the display item 28, yet still obscure the portion of the display item 28 which is hanging over behind the outer margin 24. The appearance of the display item 28 is therefore not unsightly and preserves intact the original appearance of the display item 28. The incorporation of the slit 70 may be adaptable whether or not a magnet 64 or suction cup is used, as reflected in FIGS. 3C and 3D.

The frame 10 is thin-walled to minimize material costs and to optimize the number of frames that can be packaged in a given space. The frame 10 has stacking legs 72 that allow shipping in stacks and which minimize scratching of the frames as they are being shipped.

It is understood that the invention is not confined to the particular construction and arrangement of parts herein illustrated and described, but embraces such modified forms thereof as come within the scope of the following claims.

What is claimed is:

1. A picture display frame for a display item integrally molded in one piece comprising a generally rectangular back plate having a front and a back;

an outer margin surrounding the back plate and spaced forwardly therefrom, an inner surface of the outer margin generally joined to an outer edge of the back plate;

the inner surface of the outer margin formed in it a plurality of slots positioned so that the display item placed on the front of the back plate can have portions extending through the slots to retain the display item in place inside of the outer margin and against the front of the back plate;

a hole formed in the back plate of sufficient size and shape for a human finger to extend therethrough to dislodge a picture from the frame;

a bracket integrally molded into, and removable from, the back plate;

a plurality of sockets formed in the back of the back plate and sized so as to be able to receive one end of the bracket therein, the sockets being centrally located along at least one of the longer and one of the shorter side edges of the rectangle of the back plate so that the frame can be supported upright in one of a vertical and a horizontal orientation by the removal of the bracket from the back plate and the insertion of one of the ends of the bracket into a one of the sockets; and shipping legs provided to allow shipping of more that one display frame in a stack.

2. A picture display frame for a display item integrally molded in one piece comprising a generally rectangular back plate having a front, a back, and an outer edge;

an outer margin surrounding the back plate and spaced forwardly therefrom, an inner surface of the outer margin generally joined to the outer edge of the back plate;

the inner surface of the outer margin having formed in it a plurality of slots positioned so that the display item placed on the front of the back plate can have portions extending through the slots to retain the display item in place inside of the outer margin and against the front of the back plate;

a bracket integrally molded into, and removable from, the back plate;

a plurality of sockets formed in the back of the back plate and sized so as to be able to receive one end of the bracket therein, the sockets being centrally located along at least one of the longer and one of the shorter side edges of the rectangle of the back plate so that the frame can be supported upright in one of a vertical and a horizontal orientation by the removal of the bracket from the back plate and the insertion of one of the ends of the bracket into a one of the sockets; and spacing means for spacing the display frame from an adjacent one of the display frames when the display frames are stacked for shipping.

3. A picture display frame as claimed in claim 2 wherein the slots formed in the outer margin are located at the corners of the rectangle of the back plate.

4. A picture display frame as claimed in claim 2 wherein there is further a transparent sheet received in the frame on the back plate and sized so that its edge portions extend into the slots so that the transparent sheet can retain a display item in the frame.

5. A picture display frame as claimed in claim 4 wherein the transparent sheet includes a plurality of ears which extend into the slots provided in the outer margin.

* * * * *